US006691438B2

(12) United States Patent
Fatemi

(10) Patent No.: US 6,691,438 B2
(45) Date of Patent: Feb. 17, 2004

(54) COUPLER WITH IMPROVED STRUCTURE AND METHOD FOR MANUFACTURING SAME

(75) Inventor: Ray S. Fatemi, Fairlawn, OH (US)

(73) Assignee: JRB Company, Inc., Akron, OH (US)

( * ) Notice: Subject to any disclaimer, the term of this patent is extended or adjusted under 35 U.S.C. 154(b) by 0 days.

(21) Appl. No.: 10/131,865

(22) Filed: Apr. 25, 2002

(65) Prior Publication Data

US 2002/0157286 A1 Oct. 31, 2002

Related U.S. Application Data

(60) Provisional application No. 60/286,513, filed on Apr. 26, 2001.

(51) Int. Cl.[7] ..... E02F 3/96

(52) U.S. Cl. ..... 37/468; 37/403; 414/723

(58) Field of Search ..... 37/468, 403, 231, 37/409; 414/723; 403/31, 320–325; 172/272, 273, 275

(56) References Cited

U.S. PATENT DOCUMENTS

| | | | | | |
|---|---|---|---|---|---|
| 2,963,183 | A | * | 12/1960 | Przybylski | 414/723 |
| 3,556,323 | A | * | 1/1971 | Heimmermann et al. | 414/723 |
| 3,818,551 | A | * | 6/1974 | Coughan | 403/24 |
| 4,955,779 | A | * | 9/1990 | Knackstedt | 414/723 |
| 5,179,794 | A | * | 1/1993 | Ballinger | 37/468 |
| 5,332,353 | A | * | 7/1994 | Arnold | 414/723 |
| 5,465,513 | A | * | 11/1995 | Sonerud | 37/468 |
| 5,597,283 | A | * | 1/1997 | Jones | 414/723 |
| 5,890,871 | A | * | 4/1999 | Woerman | 414/723 |
| 6,254,331 | B1 | * | 7/2001 | Pisco et al. | 414/723 |
| RE37,339 | E | * | 8/2001 | Horton | 37/468 |
| 6,305,106 | B1 | * | 10/2001 | McLellan | 37/468 |
| 6,379,075 | B1 | * | 4/2002 | Shamblin et al. | 403/322.1 |
| 6,422,805 | B1 | * | 7/2002 | Miller | 414/723 |
| 6,431,785 | B1 | * | 8/2002 | Melander | 403/322.1 |
| 6,487,800 | B1 | * | 12/2002 | Evans et al. | 37/468 |
| 2002/0071754 | A1 | * | 6/2002 | Fatemi | 414/723 |

OTHER PUBLICATIONS

"JRB Slide–Loc Brouchure" (Product Introduced 1994).

* cited by examiner

*Primary Examiner*—Robert E. Pezzuto
*Assistant Examiner*—Thomas A. Beach
(74) *Attorney, Agent, or Firm*—Fay, Sharpe, Fagan, Minnich & McKee, LLP

(57) ABSTRACT

A quick-coupler for operably connecting a bucket or other implement to the arm or dipper-stick of an excavator, backhoe and/or other machine includes a first and second laterally spaced-apart rib assemblies. A first upper bearing plate is connected to the first rib assembly and a second upper bearing plate connected to the second rib assembly. At least one of the first and second upper bearing plates and the lower bearing plate includes a tab projecting outwardly therefrom that is inserted into a corresponding tab-opening defined in one of the first and second rib assemblies. A lock member is slidably positioned in the slot, and an actuator is located in the space between the first and second rib assemblies. The actuator is operably coupled to the lock member for moving the lock member between first and second operative positions. A method of constructing a coupler is disclosed.

18 Claims, 6 Drawing Sheets

COUPLER WITH IMPROVED STRUCTURE AND METHOD FOR MANUFACTURING SAME

CROSS-REFERENCE TO RELATED APPLICATION

This application claims priority from and hereby expressly incorporates by reference U.S. provisional application No. 60/286,513 filed Apr. 26, 2001.

BACKGROUND OF THE INVENTION

The present invention relates generally to couplers used to connect implements such as buckets, grapples, shears and the like to a "dipper stick" or arm of an excavator, backhoe, tractor or other prime mover. More particularly, the present invention relates to an improved structure for such a coupler that is more efficient to manufacture in terms of time and materials without sacrificing strength. The method of manufacturing the subject coupler also forms a part of the present invention.

Couplers of the type described above are well-known and in widespread use. One common coupler is available commercially from JRB Company, Inc., Akron, Ohio, U.S.A., and is sold under the registered trademarks SLIDE-LOC® and SMART-LOC™. Notwithstanding the commercial success of the SLIDE-LOC® and SMART-LOC™ couplers, it has been deemed desirable to develop an improved coupler that is more efficient to manufacture and that includes a more open central region that facilitates mounting of a fluid cylinder and other components to the coupler as required.

SUMMARY OF THE INVENTION

In accordance with a first aspect of the present development, a method for constructing a coupler comprises securing a first upper bearing plate to a first female rib member and securing a second upper bearing plate to a second female rib member. The first and second female rib members each define first and second spaced-apart recesses adapted to receive first and second pins of an implement. The first and second female rib members are arranged in spaced-apart relation with the first and second bearing plates aligned and spaced-apart from each other, the first recesses aligned with each other to define a first pin-receiving hook and the second recesses aligned with each other to define a second pin-receiving hook. A lower bearing plate is positioned between said first and second female rib members and is spaced from the first and second upper bearing plates whereby a slot is defined between the lower bearing plate and the first and second upper bearing plates. At least one cross member is positioned between the first and second female rib members. This cross member is secured to both the first and second female rib members. The lower bearing plate is secured to both the first and second female rib members. A first outer rib member is connected and secured to the first female rib member to define a first rib assembly and a second outer rib member is connected and secured to the second female rib member to define a second rib assembly. The first and second outer rib members each define first and second spaced apart pin openings, and the first pin openings are aligned with each other and the second pin openings are aligned with each other. A lock member is slidably positioned in the space defined between the upper bearing plate and the lower bearing plate. An actuator is secured in a space located between the first and second rib assemblies. The actuator is operably connected to the lock member whereby the actuator is adapted to move the lock member between a retracted position and an extended position. The lock member extends at least partially into the second pin-receiving hook when in the extended position.

In accordance with another aspect of the present development, a coupler formed in accordance with the foregoing method is provided.

In accordance with a further aspect of the present development, a coupler includes first and second laterally spaced-apart rib assemblies defining a space therebetween and each comprising first and second pin-openings. The first openings of the first and second rib assemblies are aligned with each other and the second openings of the first and second rib assemblies are aligned with each other. A plurality of cross-members extend between and interconnect the first and second rib assemblies. A first upper bearing plate is connected to the first rib assembly and a second upper bearing plate connected to the second rib assembly. A lower bearing plate is connected to both the first and second rib assemblies and is spaced from the first and second upper bearing plates so that a slot is defined between the lower bearing plate and the first and second upper bearing plates. At least one of the first and second upper bearing plates and the lower bearing plate includes a tab projecting outwardly therefrom that is inserted into a corresponding tab-opening defined in one of the first and second rib assemblies. A lock member is slidably positioned in the slot, and an actuator is located in the space between said first and second rib assemblies. The actuator is operably coupled to the lock member for moving the lock member between first and second operative positions.

One advantage of the present invention resides in the provision of a novel and unobvious coupler and method for manufacturing same.

Another advantage of the present invention is found in the provision of a coupler that allows for a rear-mounted fluid cylinder or other actuation means that extends and retracts a locking plate.

A further advantage of the present invention resides in the provision of a coupler that is lighter weight that conventional couplers of comparable size without sacrificing strength and durability.

Still another advantage of the present invention is the provision of a coupler wherein machining and welding are minimized to reduce assembly time and expense.

A still further advantage of the present invention resides in the provision of a method for manufacturing a coupler that is highly efficient in that it facilitates improved material flow and minimizes set-up and staging of sub-assemblies of the coupler.

A further advantage of the present invention resides in the provision of a coupler wherein open space is provided to facilitate self-cleaning of mud and other debris from the coupler body.

A still further advantage of the present invention is found in the provision of a manufacturing method for a coupler that does not require use of a jig to hold the coupler components during assembly.

Still other benefits and advantages of the present invention will become apparent to those of ordinary skill in the art to which the invention pertains upon reading the present specification.

BRIEF DESCRIPTION OF THE DRAWINGS

The invention comprises various components and arrangements of components, and various steps and arrangements of steps, preferred embodiments of which are described herein and illustrated in the accompanying drawings that form a part hereof and wherein.

DETAILED DESCRIPTION OF PREFERRED EMBODIMENTS

Figure 1:
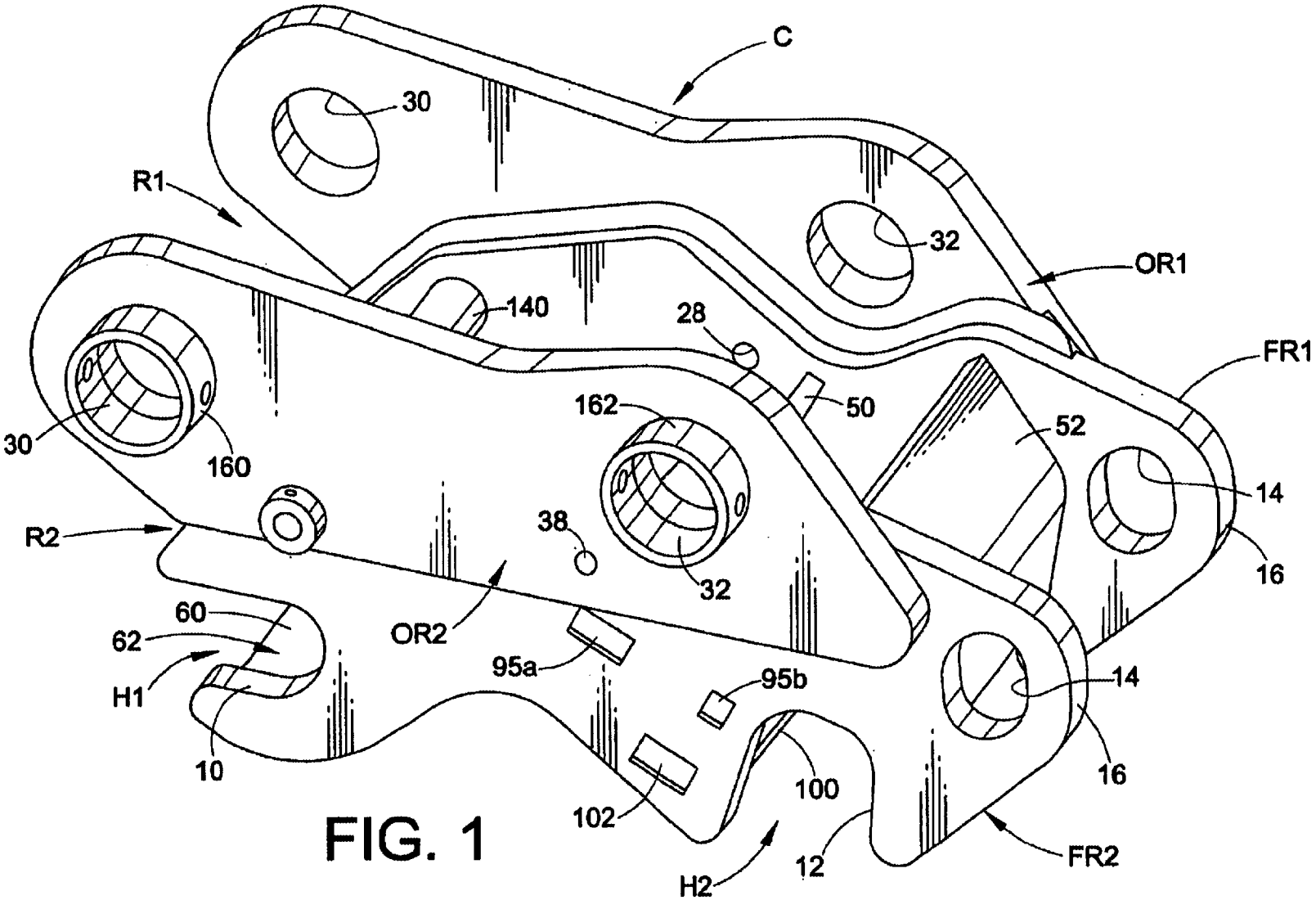
FIG. 1 is an isometric view of a coupler formed in accordance with the present invention.
Figure 2:
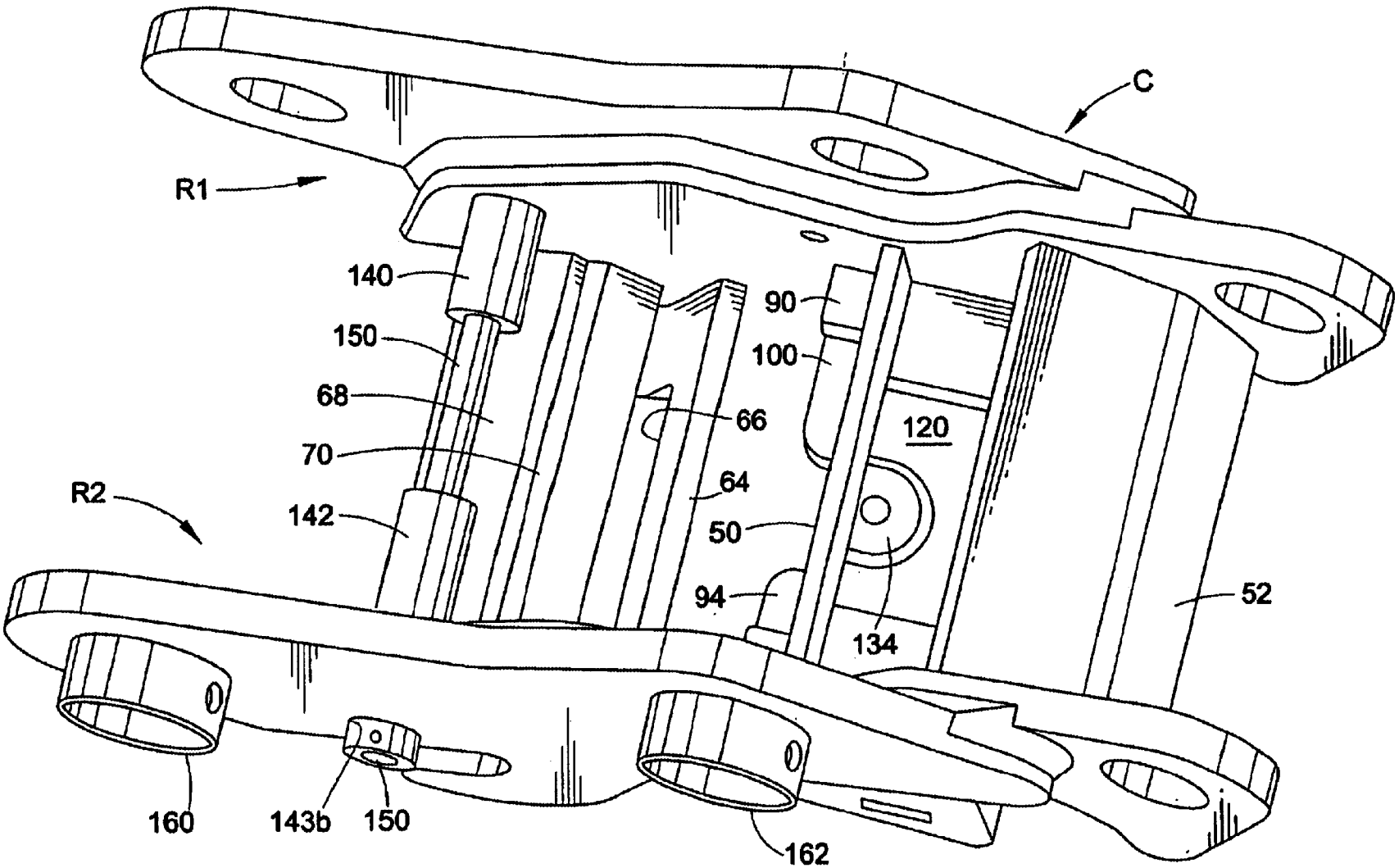
FIG. 2 is another isometric view of the coupler of FIG. 1.

Referring now to the drawings, wherein the showings are for purposes of illustrating a preferred embodiment only and not for purposes of limiting the invention in any way, a coupler C formed in accordance with the present invention is shown in FIGS. 1 and 2. The coupler C comprises first and second lateral rib assemblies R1, R2 that are preferably mirror images of each other. The rib assemblies R1, R2 preferably respectively comprise a female rib FR1, FR2 and an outer rib OR1, OR2 fixedly secured to the female rib by welding or other suitable and convenient means (see also FIG. 6).

Figure 6:
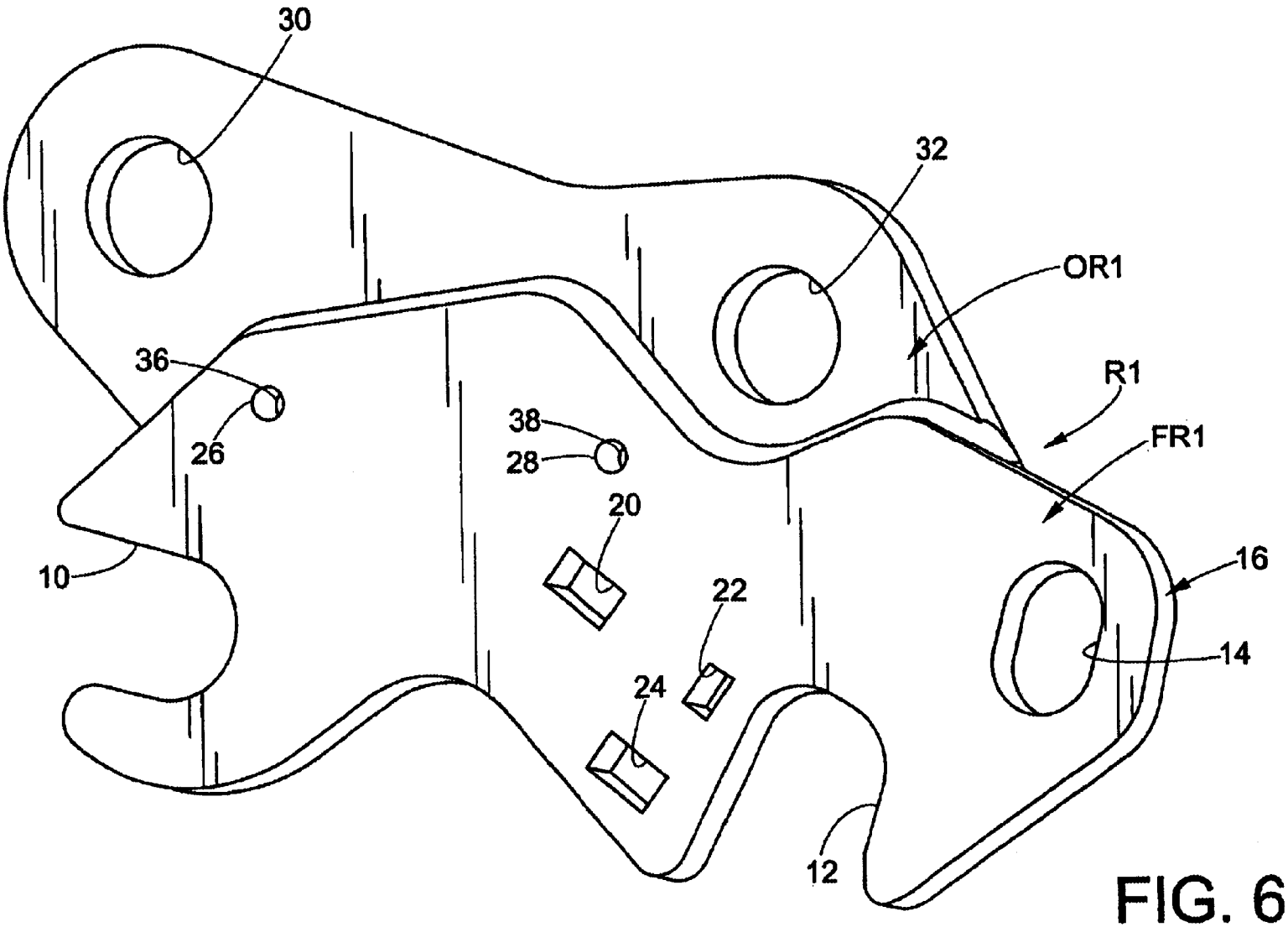

The rib assembly R1 is illustrated alone in FIG. 6 and clearly shows the structure of the female and outer rib members FR1, OR1. Although not shown in FIG. 6, the rib assembly R2 is a mirror image of the rib assembly R1. Referring to FIGS. 1, 2 and 6, the female rib members FR1, FR2 are cut from suitable steel plate material and each define a first or rear open U-shaped recess 10 and a second or front open U-shaped recess 12. The female rib members FR1, FR2 each further define a utility aperture 14 at a forward end 16. Intermediate the rear and front recesses 10, 12, the female rib members FR1, FR2 define multiple tab-receiving openings, preferably three opening 20, 22, 24 as illustrated herein. Finally, the female rib members FR1,FR2 define first and second spaced-apart dowel openings 26, 28.

With continuing reference to FIGS. 1, 2 and 6, the outer rib members OR1, OR2 are also mirror images of each other and are cut from suitable steel plate material and define first and second spaced-apart pin openings 30, 32. Also, the outer rib members OR1, OR2 define first and second preferably identical dowel openings that align respectively with the dowel openings 26, 28 defined by the female rib members FR1, FR2 (only the first of the first and second dowel openings of the outer ribs members OR1, OR2 is visible in the figures and is referenced at 38 in FIG. 1). The location of the second dowel opening will become readily apparent to those of ordinary skill in the art upon a complete reading of the present disclosure.

Figure 3:
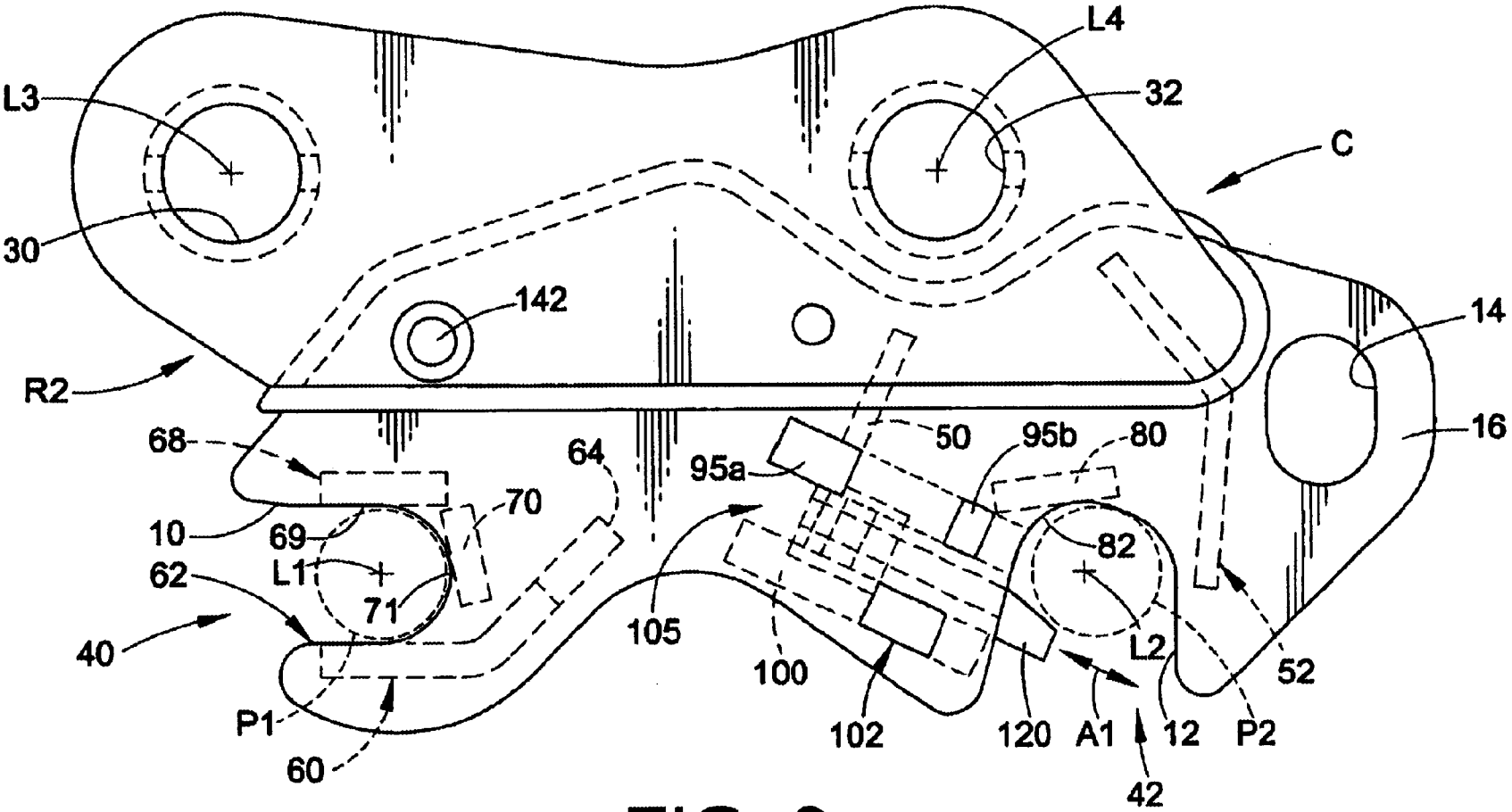
FIG. 3 is a side elevational view of the coupler shown in FIG. 1.

The rib assemblies R1, R2 are arranged in spaced-apart parallel relation to each other and are aligned with each other so that the rear recesses 10, the front recesses 12, the first pin openings 30 and the second pin openings 32 of the rib assemblies R1,R2 are in respective alignment or registry. As shown in FIG. 3, the rear recesses 10 are registered on a common transverse axis L1 and the front recesses are registered on a common transverse axis L2. Thus, the rear recesses 10 together define a rear pin-receiving region 40, referred to herein as a rear "hook" 40, and the front recesses 12 together define a front pin-receiving region 42, referred to herein as a front "hook" 42. The front and rear hooks 40, 42 open in different directions as is generally known. Likewise, the pin openings 30 are registered on a common transverse axis L3 and the pin openings 32 are registered on a common transverse axis L4. These axes L1–L4 are parallel (within acceptable design and manufacturing tolerances) to first and second parallel spaced-apart pins (not shown) connected to a bucket or other associated implement to be picked-up by the coupler C. More specifically, the first and second parallel spaced-apart pins of the associated implement are received respectively in the rear and front hooks 40, 42. As is generally known, the arrangement of the hooks 40, 42 so that they open in different directions as shown requires that, when attaching the associated bucket or other implement to the coupler C, the first pin of the associated implement must be seated in the rear hook 40 before the second pin of the associated implement can be seated in the front hook 42. Decoupling is accomplished in the reverse order. The coupler C, itself, is connected to an arm or dipper stick and a control link of an excavator or other prime mover by a conventional pin-on connection using the aligned pin openings 30, 32, respectively. It is also preferred that the utility apertures 14 of the respective rib assemblies R1, R2 be registered with each other as shown in FIG. 3. These utility apertures provide a convenient location for connection of a chain, hook or other item to the coupler C as required for lifting, dragging or other operations.

Various members extend between and interconnect the rib assemblies R1, R2. A main cross-member 50 is defined as a rectangular steel member and is welded at its opposite ends to the rib assemblies R1, R2 to set the distance between the rib assemblies. A shield plate 52 is welded between the rib assemblies R1, R2 between the utility apertures 14 and the front recesses 12. As shown, the shield plate 52 preferably substantially isolates the forward tips 16 from the remainder of the coupler C to inhibit dirt and debris from flowing into the space between the rib assemblies R1, R2.

Figure 4:
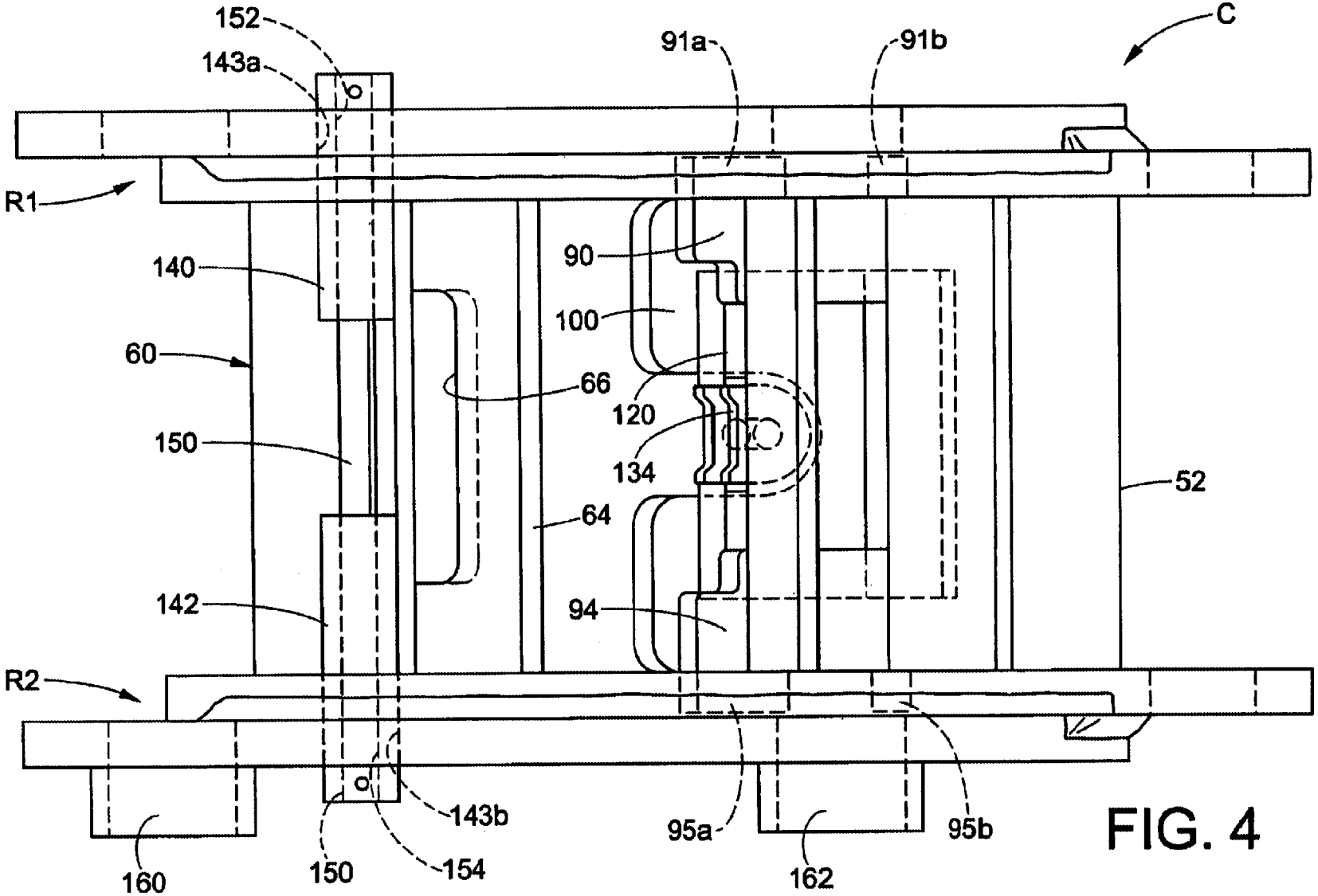
FIG. 4 is a top plan view of the coupler shown in FIG. 1.

As best seen in FIGS. 3 and 4, a plurality of cross-members extend between the rib assemblies R1, R2 adjacent the rear hook (pin-receiving area) 40. In particular, a main rear hook plate 60 is located so that an inner surface thereof 62 lies flush or even with a first or lower linear side portion of each of the recesses 10 defining the rear hook 40. For added strength, the main rear hook plate 60 extends inwardly away from the rear hook 40 so that in innermost end 64 thereof extends toward a central region of the coupler C partway between the rear and front hooks 40, 42. As may be seen clearly in FIG. 4, the main rear hook plate 60 defines a large opening 66 that helps to prevent collection of dirt and other debris in the rear pin-receiving area 40, i.e., dirt and debris exit the rear hook 40 through the opening 66. Second and third rear hook plates 68, 70 also extend between and interconnect the rib assemblies R1, R2 adjacent the rear hook 40 (the third hook plate is not shown in FIG. 5 for clarity). The second rear hook plate 68 is preferably located generally opposite the first rear hook plate 60 so that an inner surface 69 thereof is approximately flush with a second or upper linear side surface of each of the recesses 10 defining the rear hook 40. The second rear hook plate 68 can be moved toward and away from the first rear hook plate 60 a minimal amount during construction of the coupler C to adjust the tolerance of the rear hook 40. Specifically, the second rear hook plate 68 is located to ensure that the rear hook 40 is conformed to receive the first pin of the bucket or other associated implement tightly with minimal play or slop. Thus, the inner surface 69 of the second rear hook plate 68 is not necessarily flush with the upper linear side surfaces of the aligned recesses 10. The third rear hook plate 70 is located between the first and second rear hook plates 60, 68 so that its inner surface 71 is located generally tangential with the curved innermost end of the aligned recesses 10 defining the rear hook 40. Those of ordinary skill in the art will recognize that the inner surfaces 62, 69, 71 of the rear hook plates 60, 68, 70 generally approximate the general shape of the U-shaped recesses 10 that define the rear hook 40. These plates 60, 68, 70 increase the wear surface area for the first pin of an associated bucket or other implement that is received in the rear hook 40 so that all loads and wear are not concentrated directly in the aligned recesses 10. Also, the second and third rear hook plates 68, 70 are preferable rectangular in cross-section as shown herein.

With continuing reference to FIG. 3, a front hook plate 80 (not shown in FIG. 5 for clarity) extends between and interconnects the rib assemblies R1, R2 adjacent the front hook 42. Preferably the front hook plate 80 is rectangular in cross-section and includes an inner surface 82 that lies generally tangential to an innermost curved end of the recesses 12 defining the front hook 42. The front hook plate 80 increases the wear surface area for the second pin of an associated bucket or other implement that is received in the recess 42.

Figure 5:
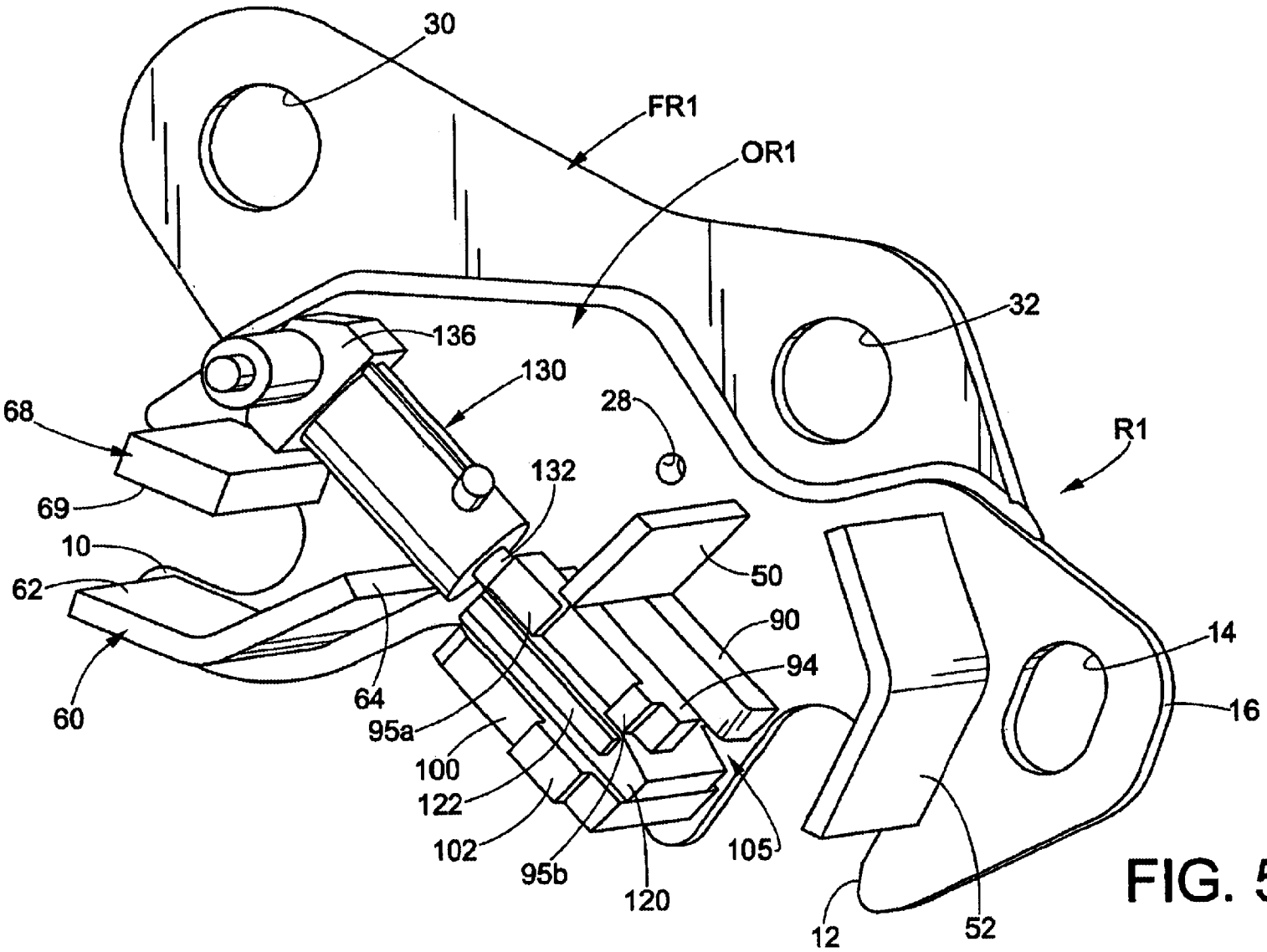
FIG. 5 is similar to FIG. 1 but shows the coupler of FIG. 1 with one of the lateral rib assemblies removed to reveal additional components of the coupler; and, FIG. 6 illustrates one of the lateral rib assemblies used to form the coupler of FIG. 1.

With reference primarily to FIGS. 4–6, a first upper bearing plate 90 is fixedly secured to the first rib assembly R1. More particularly, the first upper bearing plate 90 defines first and second tabs 91*a*, 91*b* (FIG. 4) that are received respectively in the tab-receiving openings 20, 22. When the tabs of the first upper bearing plate 90 are inserted into the openings 20, 22, the first upper bearing plate 90 is properly located relative to the first rib assembly R1. Of course, the first upper bearing plate 90 is welded in position once the tabs thereof are inserted into the tab-receiving openings 20, 22 of the first rib assembly R1. A second upper bearing plate 94 is a mirror image of the first upper bearing plate 90. It is fixedly secured to the second rib assembly R2 directly opposite the first upper bearing plate 90. As may be seen in FIGS. 3 and 5, the second upper bearing plate 94 includes first and second spaced-apart tabs 95*a*, 95*b* that are received respectively in the openings 20, 22 defined in the second rib assembly R2. The tabs 95*a*, 95*b* are identical to the tabs 91*a*, 91*b* found on the first upper bearing plate 90. The first and second upper bearing plates 90, 94 are spaced-apart from each other so that a gap is located therebetween.

A lower bearing plate 100 extends between and is fixedly secured to both rib assemblies R1, R2. The lower bearing plate 100 includes tabs 102 projecting from its opposite lateral sides. One of the tabs 102 is visible in FIG. 5, and the other tab (not shown) is identical to the tab 102 visible in FIG. 5 and located directly opposite from the tab 102. The lower bearing plate 100 is spaced apart from the first and second upper bearing plates 90, 94 so that a slot 105 is defined between the two upper bearing plates 90, 94 and the lower bearing plate 100. It is important to note that no machining or other metal working is required to form the slot 105.

A lock member 120 such as the illustrated wedge is slidably located in the slot 105. The lock member 120 is adapted for sliding movement as indicated by the arrow A1 in FIG. 3. In particular, at one extreme, the lock member 120 is movable to an extended position, as shown in FIG. 3, wherein it projects into the front hook/pin-receiving area 42. In this extended position, the lock member 120 traps or captures a pin of an associated bucket or other implement in the front hook 42. The lock member 120 is selectably movable from the extended position to a retracted position as shown in FIGS. 1 and 5. In this retracted position, the lock member 120 is moved completely out of the front hook 42 and does not interfere with placement of a pin in or removal of a pin from the front hook 42 as required to attach/detach an associated implement to the coupler C. To allow use of a single-width lock member 120 for multiple size couplers, shims 122 (FIG. 5) are located on one or both lateral sides of the lock member 120 as needed to eliminate undesired space between the lock member 120 and the rib assemblies R1, R2.

The lock member 120 can be moved manually or by fluid-power or electro-mechanical means, e.g., by a lever, a ball-screw, a fluid-cylinder, a solenoid, or other suitable and convenient actuation means. In the preferred embodiment, a fluid cylinder such as a hydraulic cylinder 130 (FIG. 5) is located between the rib assemblies R1, R2 and operably coupled to the lock member 120 to move the lock member 120 between the extended and retracted positions. Alternatively, electro-mechanical means such as a solenoid can be employed. The fluid cylinder 130 includes a piston 132 that is secured to the lock member 120 by a lug 134 as shown in FIGS. 4 and 5.

The fluid cylinder 130 is secured between the rib assemblies R1, R2 by a rear-mounting arrangement that minimizes stress on the cylinder 130, itself. Specifically, first and second bosses 140, 142 are respectively fixedly secured in bores 143*a*,143*b* (see FIG. 4) defined in the rib assemblies R1, R2, and a load-pin or cross-pin 150 is secured between the bosses 140, 142. As shown in FIG. 4, a first bore 152 extends entirely through the first boss 140, and a second bore 154 extends entirely through the second boss 142. The first and second bores 152, 154 are aligned. As shown in FIG. 5, the cylinder 130 includes a mounting base 136 that defines a through-bore that is aligned with the bores 152, 154. To secure the cylinder 130 in its operative position, the cross-pin 150 is slidably received in the aligned bores 152, 154 and through the bore defined in the cylinder mounting base 136. Although the cross-pin 150 could be welded in position, it is preferably temporarily secured in the bores 152, 154 by conventional pin holders that are secured to the outer faces of the rib assemblies R1, R2 as shown. Use of a removable cross-pin 150 facilitates repair and replacement of the cylinder 130, i.e., the cylinder 130 is easily removed by removal of the pin 150. Most preferably, the pin 150 is defined from a high strength corrosion resistant metal such as 17-4 precipitation hardening (PH) stainless steel or the like that does not corrode, is not brittle, is very strong and does not work-soften.

To construct the coupler C, no form or "jig" is required. However, it is preferred that first and second spaced apart parallel pins P1, P2 (FIG. 3) be provided that simulate the first and second pins of an associated implement so that these pins can be received respectively in the rear and front hooks 40, 42 during construction of the coupler C to facilitate alignment of the rib assemblies R1, R2 with each other. In an initial step, the first upper bearing plate 90 is temporarily secured by tack welding to the first female rib member FR1, with the tabs of the upper bearing plate 90 received in the tab-receiving openings 20, 22 of the female rib member FR1 to ensure proper and convenient location of the first upper bearing plate 90. The two female rib members FR1, FR2 are then connected in a registered, parallel, spaced-apart manner to the associated first and second spaced apart parallel pins that are used to simulate the pins of an associated implement so that a first one of the pins is received in the aligned recesses 10 and the second one of the pins is received in the aligned recesses 12 of the female rib members FR1, FR2. The aligned first recesses 10 cooperate to define a first pin-receiving hook H1 and the aligned second recesses cooperate to define a second pin-receiving hook H2 (FIG. 1).

The tabs 95*a*,95*b* of the second upper bearing plate 94 are inserted into the openings 20, 22 of the second female rib member FR2. The lock member 120, itself, or a similar block member is inserted beneath the first and second upper bearing plates 90, 94 and used to align the second upper bearing plate 94 with the first upper bearing plate 90 so that the plates 90, 94 are directly opposed from one another (the tabs 95*a*,95*b* fit loosely in the openings 20, 22 to allow for this limited adjustment). Once the second upper bearing plate 94 it is aligned with the first upper bearing plate 90, the second upper bearing plate 94 is also tack welded into position. The lower bearing plate 100 is then placed in position (but not welded at this stage) with its opposed tabs 102 respectively located in the tab-receiving openings 24 of the female rib members FR1, FR2.

The main cross-member 50 is tack welded between the first and second female members FR1, FR2 to set the spacing between the first and second female rib members FR1, FR2. The lower bearing plate 100 is then tack welded into position. The remaining cross-members such as the shield plate 52, the rear hook plates 60, 68, 70, and the front hook plate 80 are then tack welded into position.

The outer ribs OR1, OR2 are then temporarily secured to the female ribs FR1, FR2, respectively. With reference to FIG. 6, the first and second dowel openings 26, 28 of the female rib member FR1 are aligned respectively with first and second dowel openings 36, 38 defined in the first outer rib member OR1 and dowels (not shown) are inserted through and closely received in these aligned openings to temporarily fix the first female rib member FR1 to the first outer rib member OR1. These members are then tack welded together. The second female rib member FR2 and second outer rib member OR2 are secured in the same manner. FIG. 1 shows one of the dowel openings 38 defined in the second outer rib member OR2 (the other dowel opening was located where the cross-pin 150 is now shown, coaxial with the cross-pin).

At this stage, all members noted above that have been tack welded together are permanently fixedly secured to each other by welding. Next, machining is carried out to machine the pin openings 30, 32 to ensure their proper dimensions and smoothness or finish. Machining is also carried out to define the aligned openings 143*a*,143*b* through the rib assemblies R1, R2 that receive the cross-pin bosses 140, 142. More particularly, machining of these bores is carried out coaxial with the dowel openings 26 and the aligned dowel openings defined in the outer rib members OR1, OR2. No further machining is required and this provides a critical advantage relative to conventional couplers.

The bosses 140, 142 are welded into position. Also, pin holders 160, 162 are welded to an outer face of the second outer rib member OR2 coaxial with the pin openings 30, 32, respectively. As is generally well known, the pin holders are used to retain the pins by which the coupler C is operably secured to an arm or dipper stick by a pin-on connection.

The lock member 120 is positioned in the slot 105 (if not already so positioned) and the actuator such as the fluid cylinder 130 is secured in the space defined between the two rib assemblies R1, R2 as described above, i.e., by inserting the cross-pin 150 through a bore defined in the mounting base 136 of the cylinder 130. The actuator is operably connected to the lock member 120. In the illustrated example, this requires that the piston 132 of the fluid cylinder 130 be operably coupled to the lock member 120 via lug 134.

By way of example only, the rib assemblies R1, R2 and other components of the coupler C can be constructed from steel plate commonly referred to in the trade as T1 or A514 steel. Components that must be wear resistant, such as the hook plates 60, 68, 70, 80 and the lock member 120 are preferably defined from AR400 steel plate or another suitable abrasion resistant steel or other metal. Of course, other metals and other materials can be used in the alternative, and the invention is not to be construed as being limited to use of any particular materials to construct the coupler C.

Modifications and alterations will occur to those of ordinary skill in the art to which the invention pertains upon reading and understanding this specification. It is intended that the invention be construed as including and/or encompassing all such modifications and alterations.

Having thus described the preferred embodiments, what is claimed is:

1. A method for constructing a coupler comprising:

securing a first upper bearing plate to a first female rib member and securing a second upper bearing plate to a second female rib member, said first and second female rib members each defining first and second spaced-apart recesses adapted to receive first and second associated pins of an associated implement;

arranging said first and second female rib members in spaced-apart relation with said first and second bearing plates aligned and spaced-apart from each other, said first recesses aligned with each other to define a first pin-receiving hook and said second recesses aligned with each other to define a second pin-receiving hook;

positioning a lower bearing plate to extend between said first and second female rib members, said lower bearing plate spaced from said first and second upper bearing plates whereby a slot is defined between said lower bearing plate and said first and second upper bearing plates;

positioning at least one cross member to extend between said first and second female rib members;

securing said at least one cross member to both said first and second female rib members;

securing said lower bearing plate to both said first and second female rib members;

connecting and securing a first outer rib member to said first female rib member to define a first rib assembly and connecting and securing a second outer rib member to said second female rib member to define a second rib assembly, said first and second outer rib members each defining first and second spaced apart pin openings, said first pin openings aligned with each other and said second pin openings aligned with each other;

positioning a lock member slidably in the space defined between said separate first and second upper bearing plate and said lower bearing plate;

securing an actuator in a space located between said first and second rib assemblies;

operably connecting said actuator to said lock member whereby said actuator is adapted to move said lock member between a retracted position and an extended position, said lock member extending at least partially into said second pin-receiving hook when in said extended position.

2. The method of constructing a coupler as set forth in claim 1, further comprising:

machining said first and second pin opening of said first rib assembly; and, machining said first and second pin openings of said second rib assembly.

3. The method of constructing a coupler as set forth in claim 1, further comprising:

connecting a cross-pin to extend between said first and second rib assemblies, wherein said step of securing an actuator in the space between said first and second rib assemblies comprises:

connecting said actuator to said cross-pin.

4. The method of constructing a coupler as set forth in claim 3, wherein said actuator comprises a fluid cylinder.

5. The method of constructing a coupler as set forth in claim 1, wherein said step of securing said first upper bearing plate comprises inserting at least one tab that projects from said first upper bearing plate into at least one respective corresponding opening defined in said first female rib member.

6. The method of constructing a coupler as set forth in claim 5, wherein said step of securing said second upper bearing plate comprises inserting at least one tab that projects from said second upper bearing plate into at least one respective corresponding opening defined in said second female rib member.

7. The method of constructing a coupler as set forth in claim 6, further comprising:

welding said first and second upper bearing plates to said first and second female rib assemblies, respectively.

8. The method of constructing a coupler as set forth in claim 1, wherein said step of positioning a lower bearing plate to extend between said first and second female rib members comprises:

inserting a first tab that projects from said lower bearing plate into a corresponding opening defined in said first female rib member; and, inserting a second tab that projects from said lower bearing plate into a corresponding opening defined in said second female rib member.

9. The method of constructing a coupler as set forth in claim 6, wherein said at least one tab of said first upper bearing plate comprises first and second tabs inserted into first and second openings of said first female rib member and said first tab of said lower bearing plate is inserted into a third opening defined in said first female rib member, and wherein said at least one tab of said second upper bearing plate comprises first and second tabs inserted into first and second opening of said second female rib member and said second tab of said lower bearing plate is inserted into a third opening of said second female rib member.

10. The method of constructing a coupler as set forth in claim 1, wherein said step of arranging said first and second female rib members in spaced-apart relation comprises:

connecting said first female rib member to first and second spaced-apart parallel pins, with said first pin located in said first recess of said first female rib member and said second pin located in said second recess of said first female rib member;

connecting said second female rib member to said first and second spaced-apart parallel pins, with said first pin located in said first recess of said second female rib member and said second pin located in said second recess of said second female rib member.

11. The method of constructing a coupler as set forth in claim 3, wherein said step of connecting a cross-pin to extend between said first and second rib assemblies comprises removably connecting said cross-pin to both said first and second rib assemblies.

12. A coupler formed in accordance with the method of claim 1.

13. A coupler comprising:

first and second laterally spaced-apart rib assemblies defining a space therebetween and each comprising first and second pin-openings, said first openings of said first and second rib assemblies aligned with each other and said second openings of said first and second rib assemblies aligned with each other;

a plurality of cross-members extending between and interconnecting said first and second rib assemblies;

a first upper bearing plate connected to said first rib assembly;

a second upper bearing plate connected to said second rib assembly, said first and second upper bearing plates being separate and spaced-apart from each other;

a lower bearing plate connected to both said first and second rib assemblies and spaced from said first and second upper bearing plates so that a slot is defined between said lower bearing plate and said first and second upper bearing plates;

at least one of said first and second upper bearing plates and said lower bearing plate comprising a tab projecting outwardly therefrom that is inserted into a corresponding tab-opening defined in one of said first and second rib assemblies;

a lock member slidably positioned in said slot; and, an actuator located in the space between said first and second rib assemblies, said actuator operably coupled to said lock member for moving said lock member between first and second operative positions.

14. The coupler as set forth in claim 13, wherein said first upper bearing plate comprises a tab inserted into a first corresponding opening defined in said first rib assembly, and said second upper bearing plate comprises a tab inserted into a first corresponding opening defined in said second rib assembly.

15. The coupler as set forth in claim 14, wherein said first upper bearing plate comprises first and second tabs inserted respectively into first and second openings of said first rib assembly and said second upper bearing plate comprises first and second tabs inserted respectively into first and second openings of said second rib assembly.

16. The coupler as set forth in claim 15, wherein said lower bearing plate comprises first and second tabs projecting outwardly therefrom, said first tab of said lower bearing plate inserted into a third corresponding opening defined in said first rib assembly and said second tab of said lower bearing plate inserted into a third corresponding opening defined in said second rib assembly.

17. The coupler as set forth in claim 13, further comprising a cross-pin extending between said first and second rib assemblies, wherein the cross-pin is removably connected to said first and second rib assemblies and said actuator is removably connected to said cross-pin.

18. The coupler as set forth in claim 17, wherein said actuator comprises a fluid cylinder.

* * * * *